United States Patent [19]

Kienberger

[11] Patent Number: 4,737,943

[45] Date of Patent: Apr. 12, 1988

[54] FRICTION COUPLING FOR CLOCKWORKS

[75] Inventor: Peter Kienberger, VS-Villingen, Fed. Rep. of Germany

[73] Assignee: Emil Schmeckenbecher Uhrenfabrik, Villingen-Schwenningen, Fed. Rep. of Germany

[21] Appl. No.: 9,791

[22] Filed: Feb. 2, 1987

[30] Foreign Application Priority Data

Feb. 1, 1986 [DE] Fed. Rep. of Germany ..... 8602634

[51] Int. Cl.[4] ..... G04B 17/02

[52] U.S. Cl. ..... 368/180

[58] Field of Search ..... 368/180–183, 368/179, 165

[56] References Cited

U.S. PATENT DOCUMENTS 3,318,087 5/1967 Favre ..... 368/180

4,308,606 12/1981 Fehrenbacher ..... 368/180

*Primary Examiner*—Bernard Roskoski

*Attorney, Agent, or Firm*—Eugene E. Renz, Jr.

[57] ABSTRACT

A clockwork having a decorative torsion pendulum and a star wheel connected to a drive shaft of the clockworks by a friction coupling wherein a follower needle connected to the torsion spring of the torsion pendulum crosses the path traveled by the spokes of the star wheel and is driven thereby in an intermittent manner. The friction coupling comprises elastic spring fingers which bear against a surface of the hub portion of the star wheel to form a friction-locking connection therebetween.

4 Claims, 4 Drawing Sheets

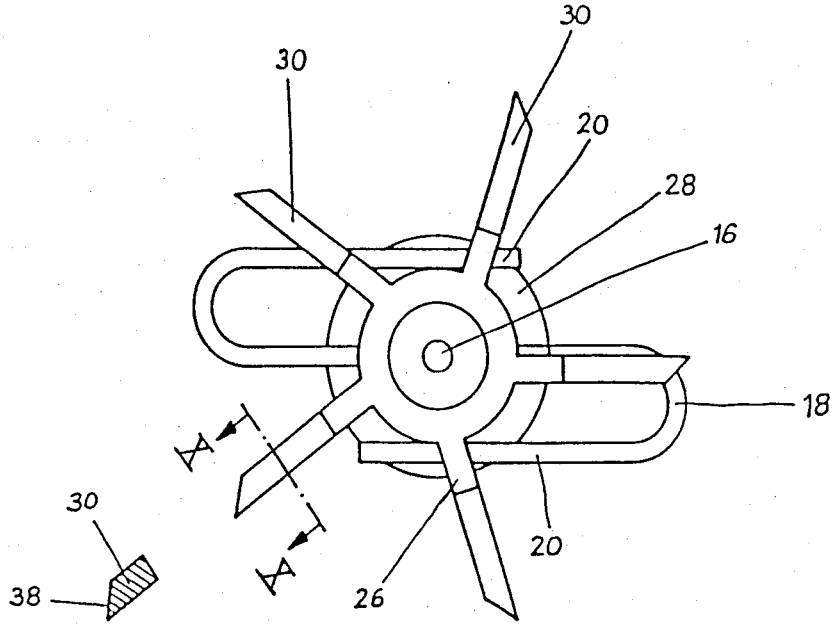
FIG. 10
FIG. 9
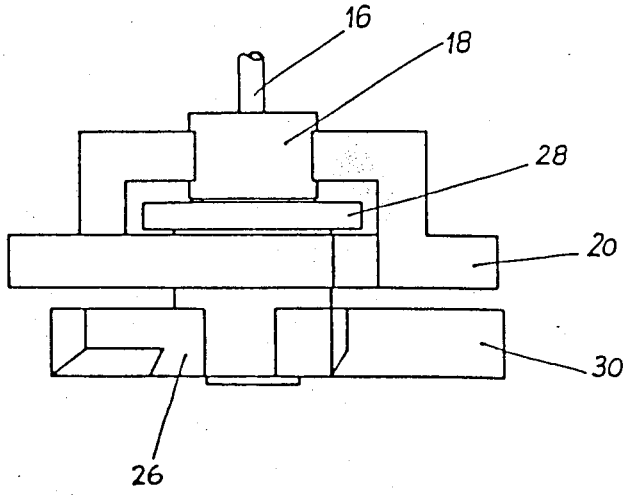
FIG. 11

FRICTION COUPLING FOR CLOCKWORKS

FIELD OF THE INVENTION

The present invention relates to improvements in torsion pendulums for electric clocks and the like and more specifically, to a novel friction coupling having elastic friction fingers which rest against a circumferential surface of the hub portion of a star wheel to form a friction-locking connection therewith.

BACKGROUND OF THE INVENTION

In clockworks of the above type, the torsion pendulum which has no effect on the accuracy of the clock is driven by way of a drive wheel operatively connected to the clockworks. The torsion pendulum is suspended in such a way that a follower needle, mounted on the upper part of the torsion spring, projects into the path of the drive wheel and is thereby deflected by the rotation of the drive wheel each time contact occurs between them so that the torsion pendulum executes a rotational, oscillating movement around the axis of the torsion spring. Since the purpose of the torsion pendulum is purely decorative, the system used to drive it should have the least possible effect on the clockworks and this is usually achieved by using a friction coupling as the drive means between the clockworks and the drive wheel. For example, the drive wheel is designed as a spoked wheel which is pressed by a star-shaped leaf spring against a friction coupling mounted on the end of the drive shaft. This coupling permits the drive shaft to turn freely when the follower needle exerts excessive counter forces.

The design described above has certain disadvantages and drawbacks. For example, the assembly is rather expensive to produce since the star-shaped leaf spring which is made of metal and has a metal busing and a screw must be brought into friction-locking contact with the spoked wheel. Further, the design requires very tight production tolerances whereby uniform and trouble-free function of the friction coupling cannot be guaranteed. Moreover, it has been found that these prior assemblies are relatively difficult and time-consuming to adjust.

SUMMARY OF THE INVENTION

With the foregoing in mind, it is an object of the present invention to provide a friction coupling for clockworks which obviates the disadvantages and drawbacks of prior assemblies noted above and provide a reliable system for the transmission of force from the clockworks to the drive wheel by the use of relatively simple, easy to produce and easy to assemble components. To this end, in accordance with the present invention, the friction coupling comprises elastic friction fingers which bear against a surface of the hub of the star wheel to form a friction-locking connection therewith. Thus, the friction coupling comprises essentially only two individual parts which are of relatively simple design and which, therefore, are economical to fabricate. The components are preferably made of an elastic material such as plastic and are, therefore, easy to assemble. In accordance with another feature of the present invention, the spokes of the star wheel are of a special design to thereby reduce the friction between the follower needle and the spokes to a minimum and also to ensure that the follower needle slides off the spoke at the earliest possible moment and in the smoothest possible manner.

BRIEF DESCRIPTION OF THE DRAWINGS

These and other objects of the present invention and the various features and details of the operation and construction thereof are hereinafter more fully set forth with reference to the accompanying drawings, wherein:

FIG. 9 shows a front view of the S-shaped part of the friction coupling assembled with the star wheel;

FIG. 10 shows a section along line X—X of FIG. 9; and

FIG. 11 shows a top view of the assembly of FIG. 9.

DETAILED DESCRIPTION OF THE PREFERRED EMBODIMENTS

Figure 1:
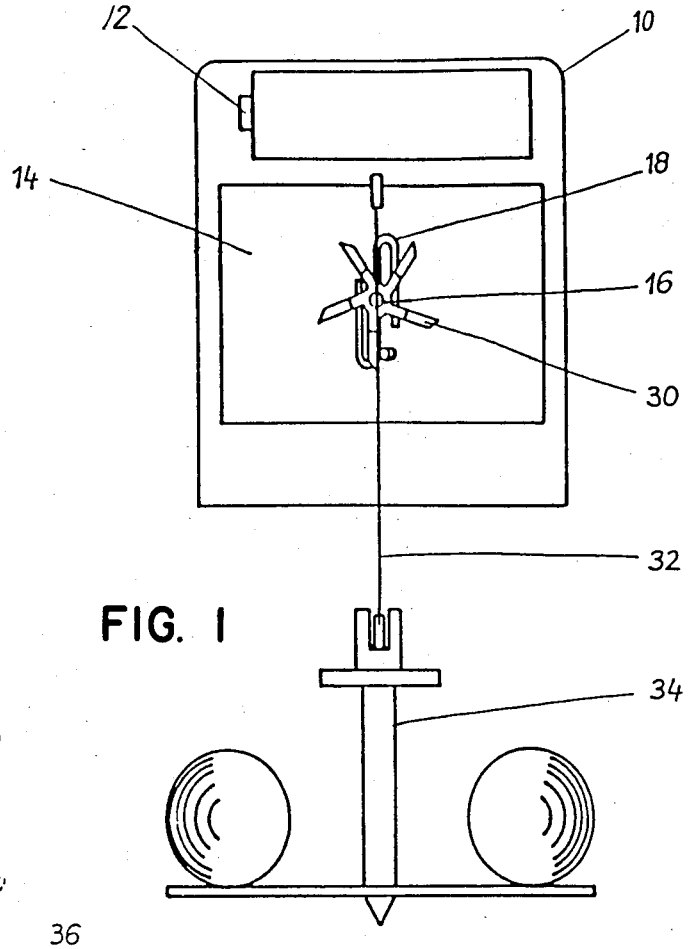
FIG. 1 is a front elevational view of a clock and torsion pendulum constructed in accordance with the present invention.
Figure 3:
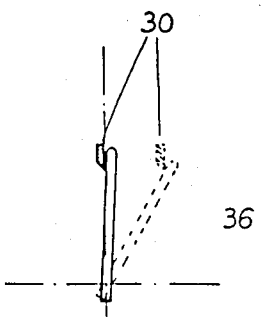
FIG. 3 is a schematic view showing the manner in which the follower needle cooperates with a spoke of the star wheel as seen from above.
Figure 2:
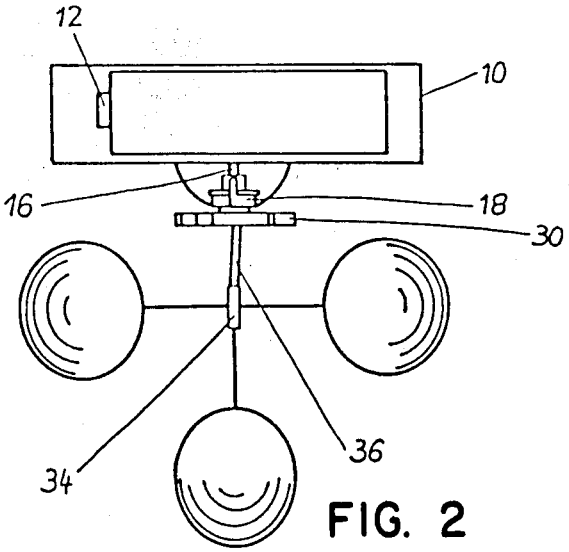
FIG. 2 is a top plan view of the clock shown in FIG. 1.
Figure 6:
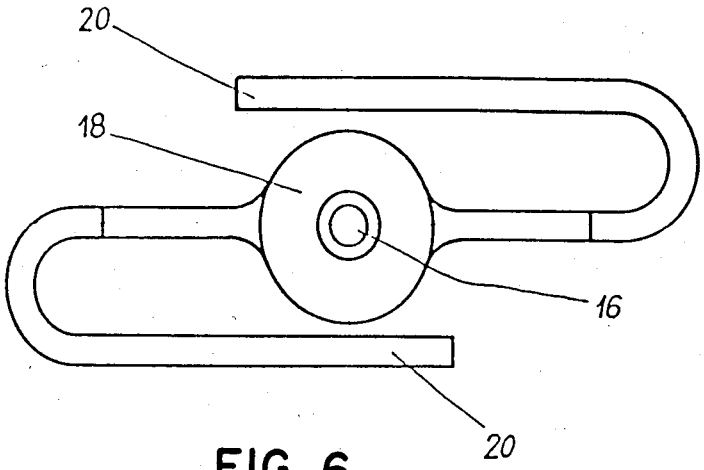
FIG. 6 shows an enlarged front view of the S-shaped part of the friction coupling with the clutch fingers.
Figure 8:
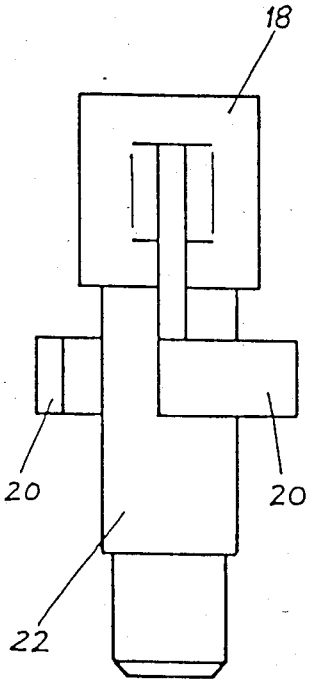
FIG. 8 shows a side view of the S-shaped part of FIGS. 6 and 7.
Figure 7:
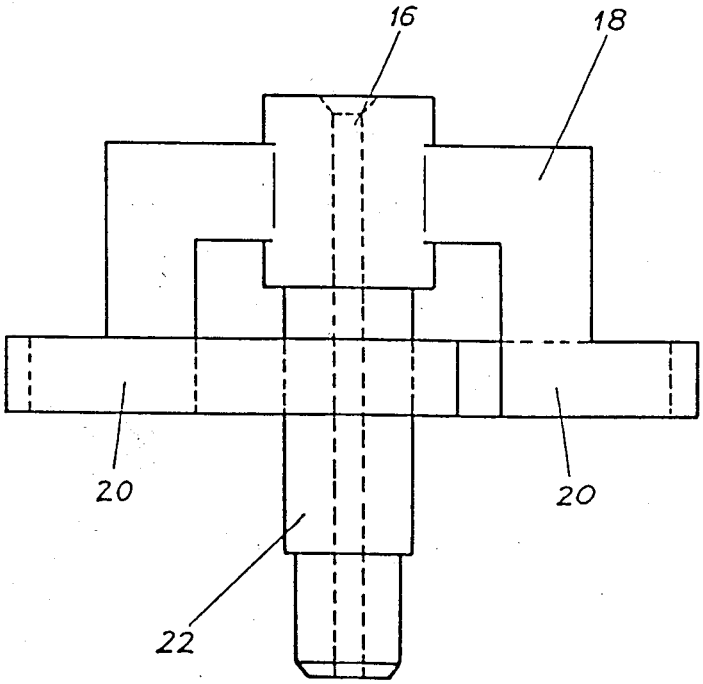
FIG. 7 shows a top view of the S-shaped part of FIG. 6.

Referring now to the drawings and particularly to FIGS. 1 and 2 thereof, there is shown a clockworks incorporating a torsion pendulum in accordance with the present invention. The clockworks comprises a clockwork housing 10 having an electric battery 12 which provides the current to drive clockworks 14. A drive shaft 16, operatively connected with the clockworks 14, projects outwardly from the housing and is connected rigidly to an S-shaped coupling member 18 of the configuration shown in FIG. 6. As illustrated therein, the coupling member 18 has firction fingers 20 arranged symmetricaly with respect to the drive shaft 16 and form the free ends of the S-shaped part. The hub of the coupling member is rigidly connected to drive shaft 16. The hub portion which is rigidly connected to the drive shaft 16 is stepped as illustrated including a tapered portion 22 on which the hub 24 of a star wheel 26 is rotatably mounted. The star wheel serves as a drive wheel. The outer terminal end of the hub 24 has an elevated collar 28 in the opposite end and carries a plurality of radially extending, circumferentially spaced spokes 30 which cooperate in the known manner with a follower needle 36 attached to a torsion spring 32 of a torsion pendulum 34.

Figure 4:
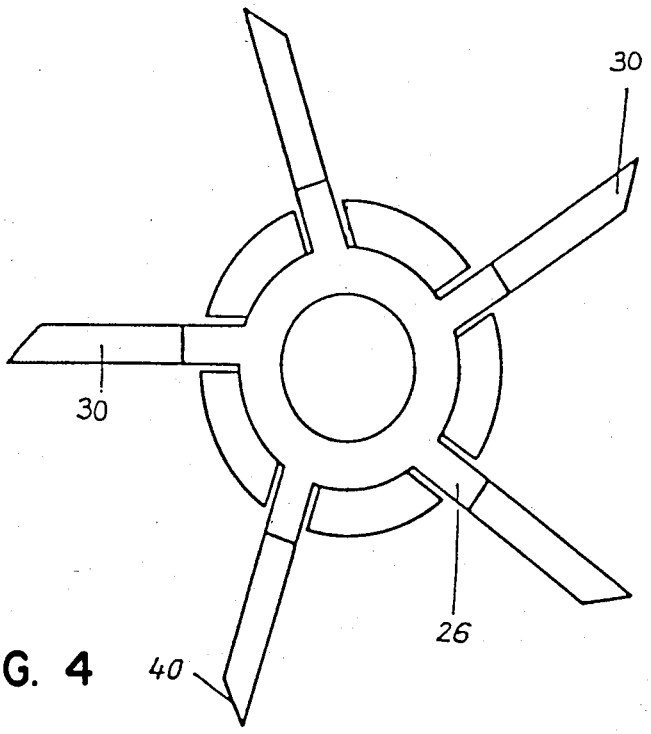
FIG. 4 shows an enlarged view of the star wheel.

As best illustrated in FIG. 10, the spokes 30 of star wheel 26 have beveled edge portions 38 which contact the follower needle 36 to minimize the friction between the follower needle 36 upon engagement. Additionally, as can be best seen from FIG. 4, the outer free terminal ends of the spokes 30 are provided on the rear side as the star wheel turns with the bevel 40 to permit the follower needle to slide off more easily after it has made contact with the trailing side of a spoke 34 and is necessarily braked by that spoke.

Figure 5:
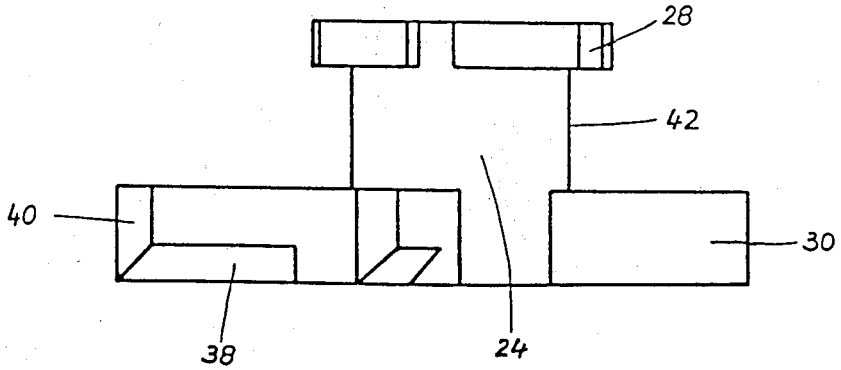
FIG. 5 shows a top view of the star wheel of FIG. 4.

Consider now assembly of the elements comprising the friction coupling. The star wheel 26 is pushed on to the portion 22 of S-shaped part 18. Note that the elastic friction fingers 20 are pulled apart or separated and brought over collar 28 of star wheel 26 in such a wheel that they latch between the collar 28 and the spokes 30 of the star wheel 26 and rest in a friction-locking manner against a circumferential surface 42 of hub 24. This can best be seen in FIG. 5. FIGS. 9 and 11 show the parts assembled and specifically show the S-shaped member 18 of the friction coupling mounted on the drive shaft 16 and star wheel 26.

The S-shaped member 18 of the friction coupling is preferably made of plastic so that it is easy and inexpensive to fabricate and also to facilitate easy and simple assembly of the two main components of the friction coupling. Furthermore, the friction effect between the two parts can be optimized by selective choice of plastic materials for the S-shaped parts and the star wheel 26.

What is claimed is:

1. A clockwork having a decorative torsion pendulum and a star wheel connected to a drive shaft of the clockworks by a friction coupling wherein a follower needle connected to the torsion spring of the torsion pendulum crosses the path traveled by the spokes of the star wheel and is driven thereby in an intermittent manner, said friction coupling comprising elastic spring fingers which bear against a surface of the hub portion of the star wheel to form a friction-locking connection therebetween, said friction fingers being elements of an essentialy S-shaped coupling member located symmetrically with respect to the drive shaft of the clockwork assembly.

2. A friction coupling as claimed in claim 1, wherein the S-shaped coupling is made of a plastic material which can be injection molded.

3. A clockwork having a decorative torsion pendulum and a star wheel having radial spokes at one end and a collar at the opposite end connected to a drive shaft of the clockworks by a friction coupling wherein a follower needle connected to the torsion spring of the torsion pendulum crosses the path traveled by the spokes of the star wheel and is driven thereby in an intermittent manner, said friction coupling comprising elastic spring fingers which bear against a surface of the hub portion of the star wheel to form a friction-locking connection therebetween said friction fingers of said S-shaped coupling part being pushed elastically over the collar to lock in place and held in place between said collar and said spokes.

4. A clockwork having a decorative torsion pendulum and a star wheel having spokes wherein the cross section of each spoke has a bevel on the side facing the torsion pendulum connected to a drive shaft of the clockworks by a friction coupling wherein a follower needle connected to the torsion spring of the torsion pendulum crosses the path traveled by the spokes of the star wheel and is driven thereby in an intermittent manner, said friction coupling comprising elastic spring fingers which bear against a surface of the hub portion of the star wheel to form a friction-locking connection therebetween.

* * * * *